US006699603B1

(12) United States Patent
Ohmi et al.

(10) Patent No.: US 6,699,603 B1
(45) Date of Patent: Mar. 2, 2004

(54) STAINLESS STEEL HAVING PASSIVE FLUORIDE FILM FORMED THEREON AND EQUIPMENT MANUFACTURED THEREFROM

(75) Inventors: Tadahiro Ohmi, Miyagi-ken (JP); Hirohisa Kikuyama, Osaka-fu (JP); Masayuki Miyashita, Osaka-fu (JP); Hiroto Izumi, Osaka-fu (JP); Takanobu Kujime, Osaka-fu (JP)

(73) Assignee: Stella Chemifa Kabushiki Kaisha, Osaka-Fu (JP)

( * ) Notice: Subject to any disclaimer, the term of this patent is extended or adjusted under 35 U.S.C. 154(b) by 0 days.

(21) Appl. No.: 09/857,117

(22) PCT Filed: Dec. 4, 1998

(86) PCT No.: PCT/JP98/05491

§ 371 (c)(1),
(2), (4) Date: Dec. 26, 2001

(87) PCT Pub. No.: WO00/34546

PCT Pub. Date: Jun. 15, 2000

(51) Int. Cl.[7] ..... C23C 8/06; C23C 8/08

(52) U.S. Cl. ..... 428/696; 428/472.2; 428/457; 148/283; 148/597

(58) Field of Search ..... 428/696, 472.2, 428/457; 148/283, 597

(56) References Cited

U.S. PATENT DOCUMENTS

| | | | | | |
|---|---|---|---|---|---|
| 5,009,963 | A | * | 4/1991 | Ohmi et al. | 118/726 |
| 5,272,417 | A | * | 12/1993 | Ohmi | 156/345.47 |
| 5,605,742 | A | * | 2/1997 | Ohmi et al. | 428/216 |
| 6,215,806 | B1 | * | 4/2001 | Ohmi et al. | 372/34 |
| 6,220,500 | B1 | * | 4/2001 | Ohmi et al. | 134/3 |

FOREIGN PATENT DOCUMENTS

| | | | |
|---|---|---|---|
| JP | 2-175855 | 7/1990 | C23C/8/08 |
| JP | 3-215656 | 9/1991 | C23C/8/08 |

* cited by examiner

*Primary Examiner*—John J. Zimmerman
*Assistant Examiner*—Jason Savage
(74) *Attorney, Agent, or Firm*—Ronald J. Knuth

(57) ABSTRACT

A stainless steel with a passive state fluorinated film formed thereon, which is easy to construct and does not produce particles even when it is welded, and a device using the same. The stainless steel does not cause leakage even when said film is formed on a sealing surface of a joint and a valve seat surface. The stainless steel is characterized in that at least a part of the surface coated with a passive state fluorinated film not thicker than 190Å consisting of a metal fluoride as a main component.

7 Claims, 4 Drawing Sheets

STAINLESS STEEL HAVING PASSIVE FLUORIDE FILM FORMED THEREON AND EQUIPMENT MANUFACTURED THEREFROM

FIELD OF THE INVENTION

This invention relates to stainless steel with a passive state fluorinated film formed thereon and a device using the same.

BACKGROUND OF THE TECHNOLOGY

Various kinds of special gases are used in semiconductor production processes, and most of them exhibit corrosive properties themselves or they react with moisture in the atmosphere and are formed into substances exhibiting corrosiveness. Usually, chambers for handling these special gases, piping therefor, valves essential for supplying the gases, or the like are made of stainless steel, and have such a feature as they are easily corroded by the above special gases.

Moreover, semiconductor devices have increasingly improved integration year by year, and the dimensions of unit elements have also been decrease year by year as the integration is improved. As the unit element is decreased in dimension, dimensions of a pattern to be drawn on a silicon substrate in the semiconductor manufacturing process have become extremely small, and it has become difficult to draw required lines with an aligner using g-line and i-line which have conventionally been used.

For this reason, an excimer-laser aligner is worthy of use at present. Dilute fluorine gas is filled in a laser chamber of an excimer laser aligner.

FIG. 5 shows an outline drawing of the laser chamber.

As shown in FIG. 5, the laser chamber 1 comprises two stainless housing members 13, 14, and the housing members 13. 14 are sealed with an O-ring 15. A cathode 18 is fixed to the housing member via an insulating body 16 and a cathode supporting member 17. An anode 19 is fixed to the housing 13 via an anode supporting member 20. 21 is a connector for connecting the cathode 18 with a pulse oscillator (not shown in the figure).

Moreover, 22 is a sealing member such as a O-ring.

In the laser chamber 1, a blower for circulating a gas, a heat exchanger, and other devices (not shown) are arranged.

27 is a pipe arrangement for fluorine gas supply line made of stainless steel.

However, in such a device, the inner wall of the pipe arrangement 27 for the dilute fluorine gas supply line made of stainless steel, the inner walls of the housings 13, 14, or the outer walls of the devices arranged in the chamber 1 reacts with the fluorine gas, and the fluorine gas is consumed. As the result, it is difficult to stably supply the dilute fluorine gas. Therefore, in the present situation, the gas piping 27 for the dilute fluorine gas supply line has been made up first, and then the dilute fluorine gas has been filled in the supply line, to let the fluorine gas react with the inner wall of the supply line before use.

However, it is impossible to operate a semiconductor production line in the pre-reaction period. Moreover, even in the pre-reacted supply line, the reaction proceeds further between the fluorine gas and the inner wall of the supply line during use, as a result, it is difficult at the present to use the dilute fluorine gas stabilized in density or the like.

In order to solve this problem, the applicants of the present invention have repeatedly researched corrosivity and reactivity of metal surfaces, and as a result, they found out that it was possible to form a passive state fluorinated film having good corrosion resistance against corrosive gasses, above all, fluorine gas by making fluorine gas positively react with a stainless steel surface for fluorination at a sufficient temperature, to form thereon a film of a metal fluoride as a main component, and then heat-treating this film in an atmosphere of an inert gas, and they already applied for the patents based on these invention (refer to the Japanese Patent Provisional Publications 2-263972 (263972/1990), 3-213656 (213656/1991), and 5-315 (3315/1.9.93A).

As the result of their continuing research for new technology, the applicants of these inventions have found out the following fact.

Namely, any of the passive state fluorinated films applied for the above patents are not less than 500 Å in thickness. When the passive state fluorinated films have such a thick film thickness, firstly, metal deposits are produced at the time of welding the gas piping or the like and the produced metal deposits stay in the piping as particles. Secondly, when a thick passive state fluorinated film is formed on a sealing surface of a joint and a valve seat face, it causes leakage disabling them to be usable.

As countermeasures, it can be considered that the passive state fluorinated film be removed from the welding part before welding, and that the passive state fluorinated film be formed by masking only the sealing surface of the joint and the surface or the valve seat.

However, both methods have lacked productivity and have been difficult for practical use. Above all, it has taken a great amount of time to complete the piping arrangement because it has to be welded at as many as hundreds of points.

SUMMARY OF THE INVENTION

The purposes of this invention are to provide stainless steel coated with the passive state fluorinated film thereon, which is easy to construct and does not produce particles even though it is welded, and to provide a device for using the same.

The purposes of this invention are also to provide stainless steel coated with the passive state fluorinated film thereon which does not cause leakage even if the passive state fluorinated film is formed on the sealing surface of the joint and the seat surface of the valve, and to provide a device using the same.

The stainless steel coated with the passive state fluorinated film in accordance with this invention is characterized in that at least a part of the surface is coated with a passive state fluorinated film of 190 Å or less in thickness consisting of metal fluoride as a main component.

Here, as stainless steel, austenitic stainless steel, ferritic stainless steel, and other stainless steel can be used. Especially, SUS316 or SUZS316L is preferred for the use.

According to this invention, a passive state fluorinated film is formed on the stainless steel, and the thickness of the passive state fluorinated film is made to be 190 Å or less. The particles produced at the time of welding decrease sharply under 190 Å as a critical value, and sealing performance is also radically improved.

As for a lower limit, 5 Å are preferred. The reason is that a film thinner than this is difficult to exist as a film.

The formation of the passive state fluoride is preferred to be performed, for example, in the following method.

A stainless steel surface is mirror-finished by electrolytic polishing or the like, and then it is baked in a high-purity inert gas (for example, nitrogen, argon, helium, etc.) to remove moisture content from the stainless steel surface.

For an inert gas, it is preferred to reduce a density of impurities such as moisture to 50 ppb or less, and a density of 20 ppb or less is more preferable, and 15 ppb or less is most preferable.

Following the above, a film of a metal fluoride is formed, at least, on a part or the whole of the stainless steel surface (fluorination).

For a gas at the fluorination, 100% fluorine gas or dilute fluorine gas with an inert gas is used. Then, for the gas at the fluorination, it is favorable to use a gas with a 50 ppb or less impurity content such as moisture, and a gas with a 20 ppb or less impurity content is more favorable, and a gas with a 15 ppb or less impurity content is further more favorable.

Temperatures for the fluorination are preferred to be 50° C. or higher, and temperatures of 100 to 200° C. are more preferable, and temperatures between 120 to 170° C. are most preferable. A fluorination time is preferred to be not shorter than 10 minutes, and the fluorination time for 30 minutes to 5 hours is more preferable.

The thickness of the passive state fluorinated film can be controlled by varying the temperature, time, and density of fluorine in the inert gas at the time of fluorination as necessary.

For example, when the fluorination is performed for three hours at 150° C. by using 1% fluorine gas diluted with nitrogen gas, a 190 Å thick passive state fluorinated film is formed. Heat treatment at 50° C. or higher after the fluorination is preferable, and it is more preferable to conduct the treatment at 100 to 400° C. A treatment time for 10 minutes or longer is preferable, and that for 30 minutes to 15 hours is more preferable.

DESCRIPTIONS OF THE REFERENCE NUMBERS

Figure 1:
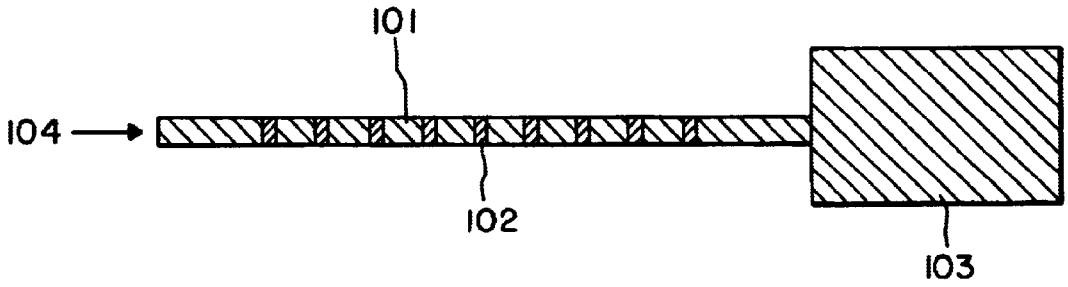
FIG. 1 is a drawing showing an experiment system for measuring particles coming out of the inside of the piping after it has been treated by fluorinated passivation and welded.

101: ¼ inch stainless tube
102: Welded parts
103: Particle measuring instrument
201: Joint treated by fluorinated passivation
202: Nut
203: Gasket
204: Joint treated by fluorinated passivation
205: Male nut
206: Helium leakage detector
207: Helium gas blowing point
301: Fluorine gas inlet port
302: Pressure gauge
303: Filter made of stainless steel
304: ¼ inch stainless tube
305: Valve
306: Vacuum outlet
307: Exhaust port
400: Valve main body
401: Diaphragm
500: Filter
501: Filter membrane
502: Housing

DETAILED DESCRIPTION OF THE INVENTION

Embodiment

In order to explain the technical contents of this invention, typical examples are extracted and shown as the embodiments of this invention, however, this invention is not to be restricted to the embodiments.

Embodiment 1

Fluorinated passivation treatment is conducted on the inner wall of a SUS316L, stainless steel tube of a ¼ inch diameter, which is mirror-finished by electrolytic polishing, under the conditions mentioned in Table 1. The fluorinated passivation treatment is conducted in the following procedures.

1) The above-mentioned SUS316L stainless steel tube is heated up to the prescribed temperature indicated in Table 1 in a current of nitrogen gas.
2) The nitrogen gas is changed over to fluorine gas keeping the above temperature unchanged, and the stainless tube surface is made to react with the fluorine gas for the prescribed time shown in Table 1.
3) After the fluorine and the stainless tube surface have been made to react with each other for the prescribed time at the prescribed temperature shown in Table 1, the fluorine gas is changed over to the nitrogen gas and then after-heat-treatment is conducted for the prescribed time at the prescribed temperature shown in Table 1.

The passive state fluorinated film does not contain hydrate but has a composition approximately satisfying a stoichiometric (i.e., definite integral) ratio. Here, the conditions for fluorination treatment mentioned in Table 1 are examples, and the temperature and time may be changed as far as the prescribed film thickness can be obtained.

TABLE 1

| Sample No. | 1 | 2 |
|---|---|---|
| Fluorination temp. and time | 150° C., 3 hours | 200° C., 2 hours |
| After-heat-treatment temperature and time | 300° C., 1 hour | 350° C., 10 hours |
| Film thickness (Å) | 190 | 1000 |

For each of the samples 1, 2, ten pieces of stainless gas tube 101 (FIG. 1) were made, respectively. By using the ten pieces of gas tubes 101, they were but-welded at 9 points at a rotational speed of 30 rpm. After welding, one end was coupled to a particle counter 103, and the other end was used as a gas inlet 104, from which argon gas was introduced. The argon gas was introduced, and thereby the number of the particles coming out of the gas tube 101 were counted by using a HIGH PRESSURE GAS PROBE 103 of PARTICLE MEASUREMENT SYSTEMS, INC. Here, a flow rate of the introduced argon gas was set to 0.1 cf/min, and the particle diameters to be measured were set to 0.1 $\mu$m or larger.

The result of the measurement is shown in Table 2. As shown in Table 2, no particles were produced from the sample 1 (a stainless tube with 190Å thick passive state fluorinated film). From the sample 2 (a stainless tube with 1000 Å thick passive state fluorinated film), a large quantity of particles were produced, and it has been confirmed that a thinner passive state fluorinated film is superior.

TABLE 2

| Sample tube for fluorinated passivation treatment | The number of particles detected |
|---|---|
| Sample 1 (film thickness : 190Å) | 0 pieces |
| Sample 2 (film thickness : 1000Å) | 60 pieces |

Embodiment 2

Tests similar to those in the embodiment 1 were carried out by varying the fluorinated film thickness from 50 Å up to 100 Å by varying the time and temperature for the fluorination.

Figure 2:
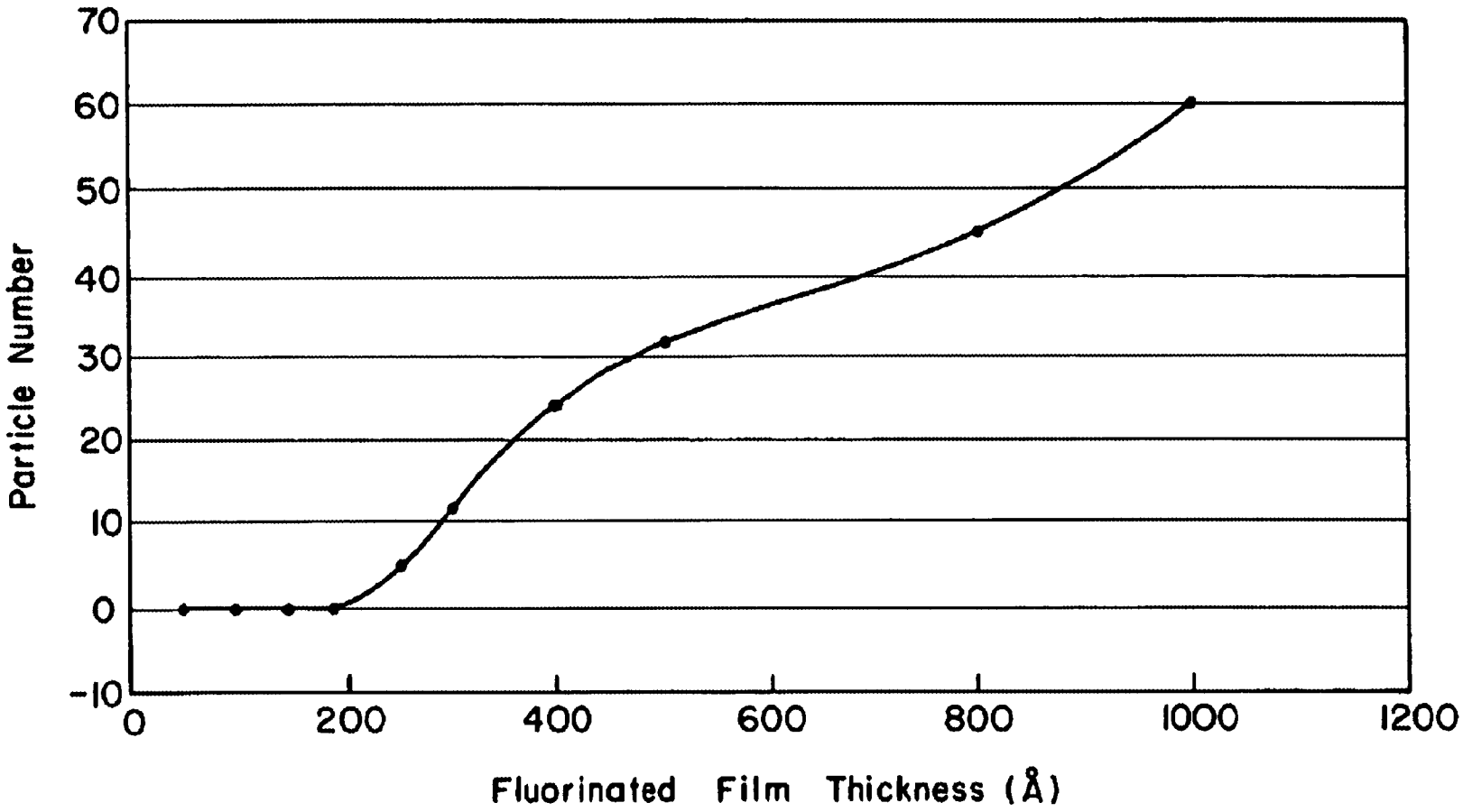
FIG. 2 is a graph showing the relation between the thickness of the passive state fluorinated film and the particle production.

FIG. 2 shows the result.

As shown in FIG. 2, it has been made clear that bordering the thickness of 190 Å, the passive state fluorinated film does not produce particles when the film is not thicker than 190 Å, while it produces particles when it is thicker than 190 Å.

Embodiment 3

Under the conditions for forming the passive state fluorinated film similar to those in the embodiment 1, a passive state fluorinated film was formed on sealing surfaces of joints made of stainless steel.

Figure 3:
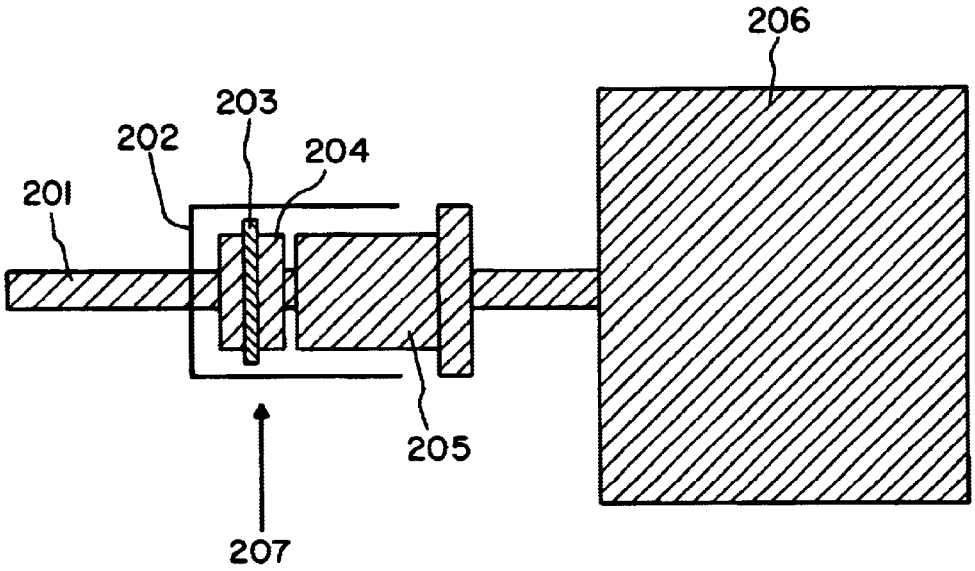
FIG. 3 is a drawing showing the experiment system for measuring leakage from a sealing surface of a joint created by fluorinated passivation.

As shown in FIG. 3, the joints 201, 204 were abutted on each other via a gasket 203, and tightened by a nut 202 and a male nut 205. A leak detector 206 was connected with one end of the gasket 203 to measure leakage from the sealing surface parts.

The result is shown in Table 3.

As shown in Table 3, leakage did not exceed the lowest detectable limit in the case of the joints with a passive state fluorinated film of 190 Å or less in thickness. On the other hand, leakage occurred in there case of the joints with a film of approximately 1000 Å in thickness.

In order to use the joints by giving them a passive state fluorinated film of about 1000 Å in thickness, the sealing parts of the joints had to be fluorination-treated by masking, for example, to prevent the passive state fluorinated film being formed on the sealing parts of the joints, and had to be used after removal of the masking. However, in the case of a thin passive state fluorinated film, even if the sealing parts of the joints were coated with the passive state fluorinated film thereon, the joints exerted their sufficient performance without leakage. Therefore, it has been confirmed that this eliminates the need for masking the sealing parts in the process of the fluorination treatment, and the thin passive state fluorinated film is superior.

TABLE 3

| Thickness of passive state fluorinated film | Leakage |
|---|---|
| Thin film (about 190Å) | None (not more than the lowest detectable limit) |
| Thick film (about 1000Å) | leaked |

Leakage 1 lowest detectable limit: 5.62×10–11 (A·cc/sec)

Embodiment 4

Figure 6:
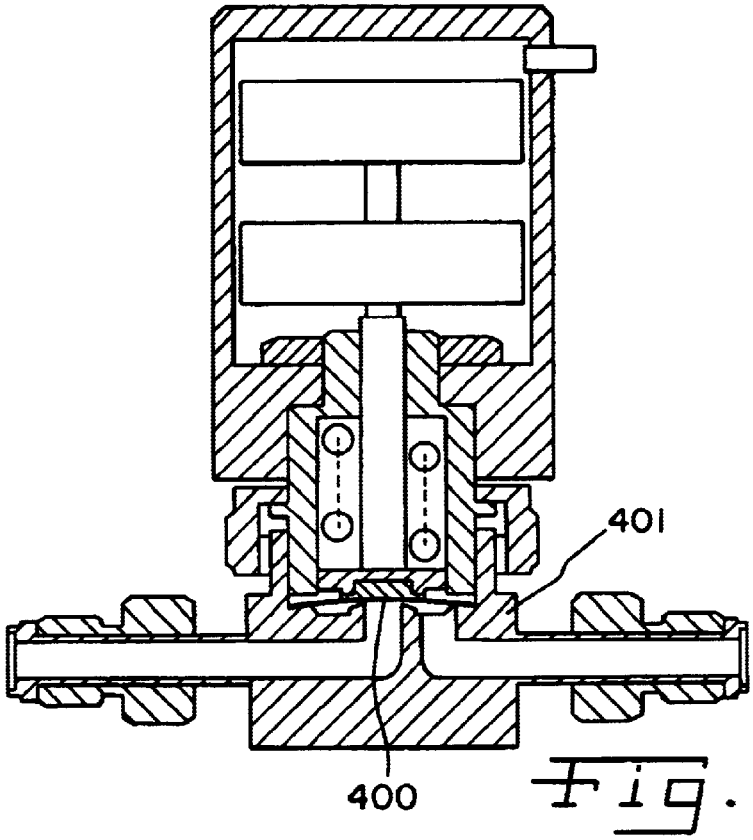
FIG. 6 is a cross-sectional drawing of the seat valve.

Under the conditions similar to those for the embodiment 1, fluorination passivation treatment was conducted on a seat valve main body 401 shown in FIG. 6.

A valve was made up by building a diaphragm 400 into the valve main body 401, and a leakage test was carried out in the valve to measure leakage from the seat part. A helium leak detector was used for measuring the leakage.

The measurement result is shown in Table 4.

As shown in Table 4, leakage did not exceed the lowest detectable limit with the valve given a passive state fluorinated film of 190 Å or less in thickness, while leakage occurred with the valve coated with a film of about 1000 Å in thickness.

In order to use the valves by giving them a passive state fluorinated film of about 1000 Å in thickness, they had to be fluorination-treated by masking, for example, the seat parts of the valves to prevent the passive state fluorinated film being formed on the seat parts of the valves, and had to be used after removal of the masking. However, in the case of a thin passive state fluorinated film, even if the seat parts of the valves were coated with the passive state fluorinated film thereon, the valves exerted their sufficient performance without leakage, therefore, it has been confirmed that this eliminates the need for masking the sealing parts in the process of the fluorination treatment, and the thinner passive state fluorinated film has superiority.

TABLE 4

| Thickness of passive state fluorinated film | Leakage |
|---|---|
| Thin film (about 190Å) | None (not more than the lowest detectable limit) |
| Thick film (about 1000Å) | leaked |

Leakage 1 lowest detectable limit: 5.62×10–11 (A·cc/sec)

Embodiment 5

In order to evaluate the performance of the passive state fluorinated film, reactivity with fluorine gas was investigated by using the filter made of stainless.

Figure 7:
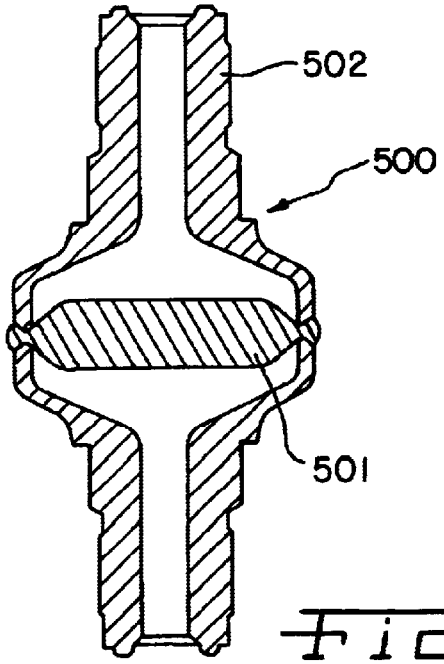
FIG. 7 is a cross-sectional drawing of the filter.

In this example, the filter as shown in FIG. 7 was used. Namely, this is a filter 500 comprised of a housing 502 and a membrane fixed to the inside of the housing by welding.

A passive state fluorinated film of 190 Å was formed on the whole surface of the filter membrane 501 and the inside of the housing 502 under the similar conditions to those for the embodiment 1.

Figure 4:
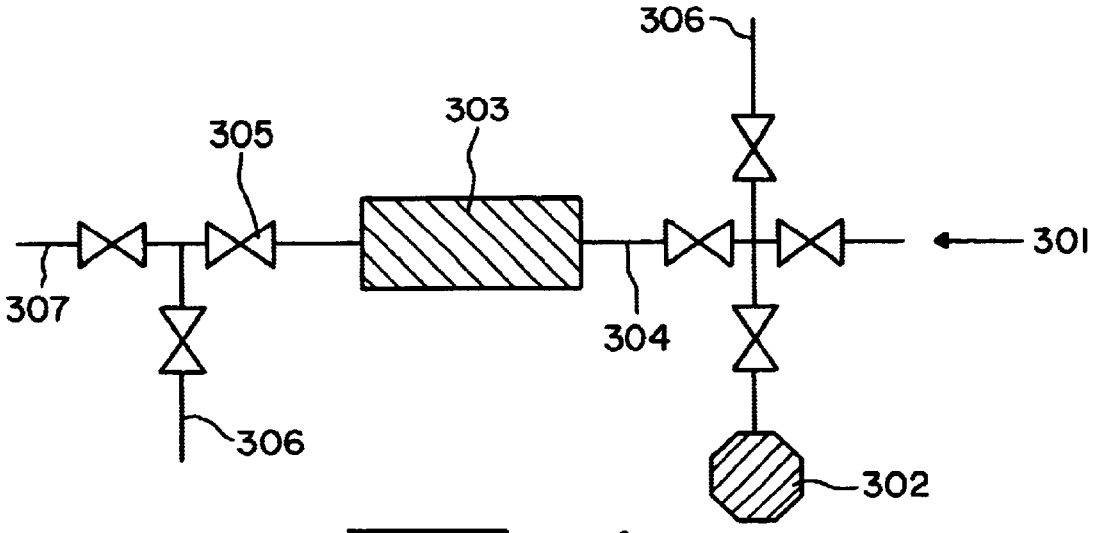
FIG. 4 is a drawing showing the experiment system for measuring variations in the fluorine gas pressure filled in a filter.
Figure 5:
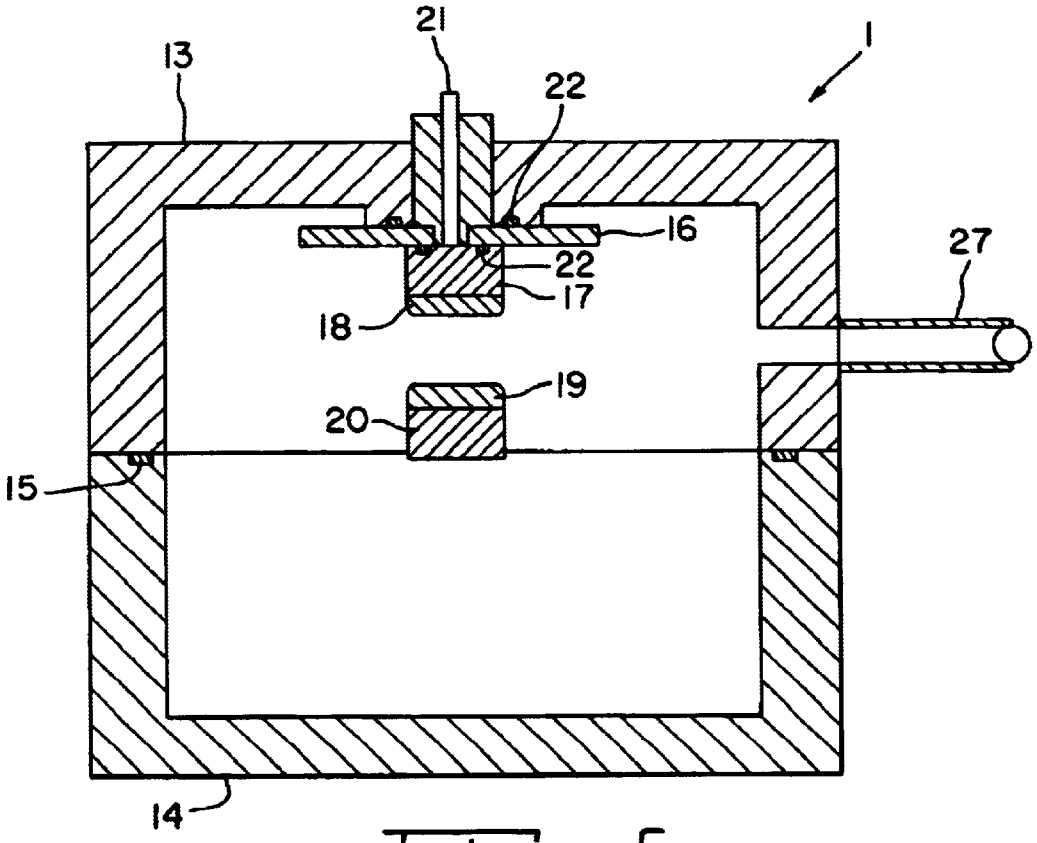
FIG. 5 shows a cross-sectional drawing of the excimer laser chamber.

On the other hand, a filter membrane 501 and a housing 502 on which a passive state fluorinated film are not formed were prepared, to construct the system shown in FIG. 4, and after the filter 303 was filled with d a mixed gas of 1% fluorine and 99% neon, it was left for a prescribed time and then the inner pressure of the filter 303 was measured by a pressure gauge 302.

As shown in Table 5, no change was observed in the pressure before and after the testing on the filter given a passive state fluorinated film of 190 Å or less formed inside, and no reaction with the fluorine gas was found. On the other hand, the inner pressure decreased after the testing on the filter without the passive state fluorinated film, and it was found out that about 80% of the fluorine gas filled in the filter reacted with the inside surface of the filter.

As obvious from this result, since even a thin passive state fluorinated film has excellent corrosion resistance to fluorine gas, it is possible to stably supply the fluorine gas without change in density by giving the gas supply system this fluorinated passivation treatment.

TABLE 5

| Fluorinated passivation film | Charged pressure of 1% fluorine gas (Torr) | Pressure after 70 hours left (Torr) |
|---|---|---|
| Given | 760 | 760 |
| Not given | 760 | 754 |

The availability on the industry

According to the invention, given a thin passive state fluorinated film onto the supply line of the gas of the fluorine series, it is possible to easily install piping and stably supply the gas.

What is claimed is:

1. A stainless steel material comprising stainless steel with a passive state fluorinated film formed thereon, said passive state fluorinated film having a metal fluoride as a main component and formed into a 190 Å thick or less layer on at least a part of the material surface, at least a surface part of said passive state fluorinated film being constituted of a layer of iron fluoride as a main component.

2. The stainless steel material according to claim 1, wherein said passive state fluorinated film is a film obtained by heating the material in a gaseous atmosphere containing fluorine to first form a metal fluoride film thereon and thereafter heat-treating the metal fluoride film in an inert gas.

3. A device, comprising:

a first steel component made of the stainless steel material according to claim 1; and a second welding component welded to said first steel component.

4. The device according to claim 3, wherein said device is one of a device for gas storage, a device for gas supply, and a device for gas reaction.

5. The device according to claim 3, wherein said device is one of a gas cylinder, a gas piping, a reducing valve, a filter, a flow meter, a pressure gauge, a mass-flow controller, a valve, a check valve, a joint, an RIE reaction system and a CVD reaction system, said device being configured for handling corrosive gasses.

6. The device according to claim 3, wherein said device is an excimer laser oscillator.

7. A device comprising a part made of stainless steel having the surface of the stainless steel according to claim 1, the surface of the stainless steel being used as a sealing surface for shutting off gas from the outside.

* * * * *